US005219822A

United States Patent [19]

Neumann

[11] Patent Number: 5,219,822

[45] Date of Patent: Jun. 15, 1993

[54] NON-VOLATILE TERTIARY AMINES IN DONOR FOR LASER-INDUCED THERMAL DYE TRANSFER

[75] Inventor: Stephen M. Neumann, Rochester, N.Y.

[73] Assignee: Eastman Kodak Company, Rochester, N.Y.

[21] Appl. No.: 861,051

[22] Filed: Apr. 1, 1992

[51] Int. Cl.[5] ..... B41M 5/035; B41M 5/38

[52] U.S. Cl. ..... 503/227; 428/195; 428/913; 428/914; 430/200; 430/201; 430/945

[58] Field of Search ..... 8/471; 428/195, 913, 428/914; 503/227; 430/200, 201, 945

[56] References Cited

U.S. PATENT DOCUMENTS 5,017,547 5/1991 DeBoer ..... 503/227

*Primary Examiner*—Bruce H. Hess

*Attorney, Agent, or Firm*—Harold E. Cole

[57] ABSTRACT

This invention relates to a dye donor element for laser-induced thermal dye transfer comprising a support having thereon a dye layer comprising an image dye in a polymeric binder and an infrared absorbing dye associated therewith, and wherein said layer also has a non-volatile tertiary amine associated therewith.

18 Claims, No Drawings

NON-VOLATILE TERTIARY AMINES IN DONOR FOR LASER-INDUCED THERMAL DYE TRANSFER

This invention relates to the use of non-volatile tertiary amines in the donor element of a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

A laser imaging system typically involves a donor element comprising a dye layer containing an infrared absorbing material, such as an infrared absorbing dye, and one or more image dyes in a binder. A decrease in transferred dye density has been observed on the receiver at high laser power settings (high amount of dye transfer). This decrease in density has been attributed to protonation of the image dyes, particularly the cyan image dyes, by acid generated from the decomposition of the infrared absorbing dye.

In U.S. Pat. No. 5,017,547, there is a disclosure in Example 2 that triethanolamine may be employed in a receiving layer for a laser-induced thermal dye transfer system. There is no indication what effect the inclusion of that material has on the system. While triethanolamine in a receiving layer will generate some base to react with the acid generated from the decomposition of the infrared absorbing dye, there will be insufficient base to react with multiple dyes in a multi-color system.

It is an object of this invention to provide a way to generate a base to react with the acid generated by the decomposition of the infrared absorbing dye in a laser-induced thermal dye transfer system. It is another object to provide such a material in sufficient quantity to protect all dyes in a multi-color system.

These and other objects are achieved in accordance with this invention which relates to a dye donor element for laser-induced thermal dye transfer comprising a support having thereon a dye layer comprising an image dye in a polymeric binder and an infrared absorbing dye associated therewith, and wherein said layer also has a non-volatile tertiary amine associated therewith.

By use of the non-volatile tertiary amine in the dye-donor element, each laser transfer of cyan, yellow and magenta image dye occurs in the presence of a fresh supply of base, thus obviating the difficulty associated with a continually depleted base incorporated in a receiver. In addition, more efficient scavenging of the acid will occur in a system where the scavenger base is incorporated in the layer in which acid is formed.

In a preferred embodiment of the invention, the infrared absorbing dye is in the dye layer. In another preferred embodiment, the amine is also in the dye layer.

Examples of non-volatile tertiary amines which can be used in the invention include the following:

A1: $(HOCH_2CH_2)_3N$ triethanolamine

A2: $(CH_3)_2N$ $N(CH_3)_2$

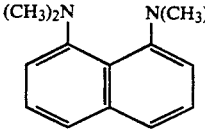

N,N,N',N'-tetramethyl-1,8-naphthylenediamine

A3: $(n\text{-}C_8H_{17})_3N$ tri-n-octylamine

A4: $(CH_3CH(OH)CH_2)_3N$ tris(2-hydroxypropyl)amine

A5: $(HOCH_2CH_2)_2N(CH_2)_2N(CH_2CH_2OH)_2$

N,N,N',N'-tetrakis(2-hydroxyethyl)ethylenediamine

A6:

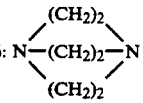

diazabicyclo-2,2,2-octane

A7: $(CH_3)_2N(CH_2)_2N(CH_3)(CH_2)_2N(CH_3)_2$ 1,1,4,7,7-Pentamethyldiethylenetriamine

A8:

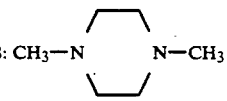

1,4-dimethylpiperazine

-continued

A9: 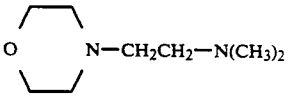

N-(2-morpholinoethyl)dimethylamine

A10: $(n\text{-}C_4H_9)_2N(CH_2CH_2OH)$

N,N-dibutyl-2-aminoethanol

A11: $CH_3CO_2CH_2CH_2N(CH_3)_2$ 2-dimethylaminoethyl acetate

A12: $C_6H_5CH_2N(CH_3)_2$

N,N-dimethylbenzylamine

A13: $C_6H_{11}N(CH_3)_2$

N-N-dimethylcyclohexylamine

A14: $C_6H_5N(CH_3)_2$

N-N-dimethylaniline

A15: 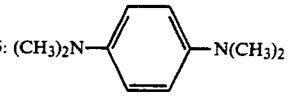

N,N,N',N'-tetramethyl-p-phenylenediamine

A16: 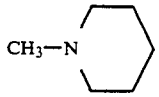

N-methylpiperidine

A17: 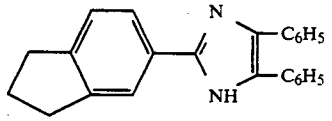

4,5-diphenyl-2-(5-indanyl)imidazole

A18: 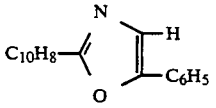

2-(1-naphthyl)-5-phenyloxazole

A19: 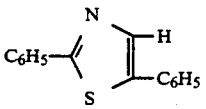

2,5-diphenyl thiazole

A20: 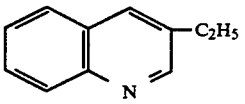

3-ethylquinoline

A21: $(C_3H_7\text{-}i)_2N{-}C({=}N{-}C_3H_7\text{-}i)N(C_3H_7\text{-}i)_2$ pentaisopropylguanidine In practice, the quantity of non-volatile tertiary amine used in the donor should equal on a molar basis the quantity of infrared absorbing dye. Higher levels, however, are not known to cause any adverse effect. This equates in a practical sense to 0.03 to 1.0 g/m$^2$, preferably 0.2–0.5 g/m$^2$, in the donor. The materials are preferably solids or, if liquid, boil at 80° C. or higher at atmospheric pressure.

Especially good results have been obtained with the following non-volatile amines: triethanolamine, N,N,N',N'-tetramethyl-1,8-naphthylenediamine, tri-n-octylamine, tris(2-hydroxypropyl)amine, N,N,N',N'-tetrakis(2-hydroxyethyl)ethylenediamine, diazabicyclo-2,2,2-octane, or pentamethyldiethylene triamine.

To obtain the laser-induced thermal dye transfer image employed in the invention, a diode laser is preferably employed since it offers substantial advantages in terms of its small size, low cost, stability, reliability, ruggedness, and ease of modulation. In practice, before any laser can be used to heat a dye-donor element, the element must contain an infrared absorbing material, such as cyanine infrared absorbing dyes as described in U.S. Pat. No. 4,973,572, or other materials as described in the following U.S. Pat. Nos. 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared absorbing dye may be contained in the dye layer itself or in a separate layer associated therewith.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses a laser as described above to form an image on a thermal print medium is described and claimed in copending U.S. application Ser. No. 451,656 of Baek and DeBoer, filed Dec. 18, 1989, the disclosure of which is hereby incorporated by reference.

Any dye can be used in the dye-donor employed in the invention provided it is transferable to the dye-receiving layer by the action of the laser. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

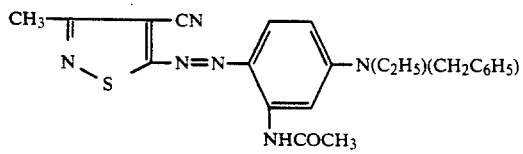

(magenta)

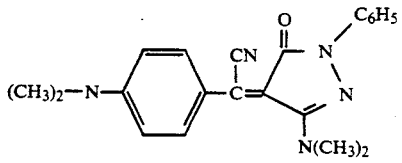

(magenta)

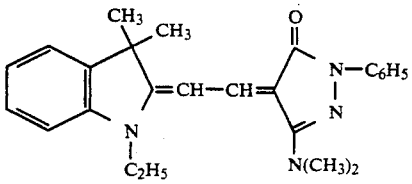

(yellow)

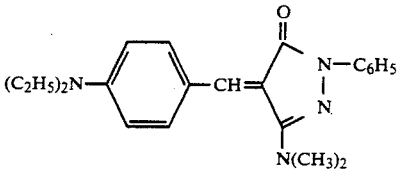

(yellow)

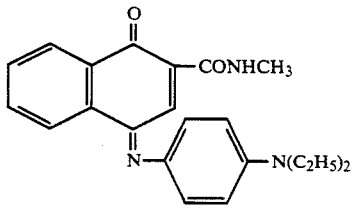

(cyan)

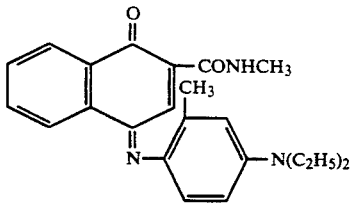

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye in the dye-donor employed in the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as polyvinylidene fluoride or poly(tetrafluoroethylene-cohexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 5 to about 200 um. It may also be coated with a subbing layer, if desired, such as those materials described in U.S. Pat. Nos. 4,695,288 or 4,737,486.

The dye-receiving element that is used with the dye-donor element employed in the invention comprises a support having thereon a dye image-receiving layer. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, a transparent film support is employed.

The dye image-receiving layer may comprise, for example, a polycarbonate, a polyurethane, a polyester, polyvinyl chloride, poly(styrene-coacrylonitrile), poly(caprolactone) or mixtures thereof. The dye image-receiving layer may be present in any amount which is effective for the intended purpose. In general, good results have been obtained at a concentration of from about 1 to about 5 g/m$^2$.

A process of forming a laser-induced thermal dye transfer image according to the invention comprises:

a) contacting at least one dye-donor element comprising a support having thereon a dye layer in a polymeric binder having an infrared absorbing material associated therewith, with a dye-receiving element comprising a support having thereon a polymeric dye image-receiving layer;

b) imagewise-heating the dye-donor element by means of a laser; and c) transferring a dye image to the dye-receiving element to form the laser-induced thermal dye transfer image, and wherein the dye-donor element contains a non-volatile amine as described above.

The following examples are provided to illustrate the invention.

EXAMPLE 1

Individual dye-donor elements were prepared by separately coating each of the following dye-layers on a 100 μm unsubbed poly(ethylene terephthalate) support:

a) a yellow dye layer of the two yellow dyes illustrated above (each at 0.23 g/m$^2$), the cyanine infrared absorbing dye illustrated below (0.10 g/m$^2$) and the amine identified in the table in a cellulose acetate propionate binder (2.5% acetyl, 46% propionyl) (0.23 g/m$^2$) coated from a dichloromethane and 1,1,2-trichloroethane solvent mixture.

b) a magenta dye layer of the two magenta dyes illustrated above (each at 0.28 g/m$^2$), the cyanine infrared absorbing dye illustrated below (0.12 g/m$^2$) and the amine identified in the table in a cellulose acetate propionate binder (2.5% acetyl, 46% propionyl) (0.28 g/m$^2$) coated from a dichloromethane and 1,1,2-trichloroethane solvent mixture.

c) a cyan dye layer of the two cyan dyes illustrated above (each at 0.39 g/m$^2$) the cyanine infrared absorbing dye illustrated below (0.13 g/m$^2$) and the amine identified in the table in a cellulose acetate propionate binder (2.5% acetyl, 46% propionyl) (0.39 g/m$^2$) coated from a dichloromethane and 1,1,2-trichloroethane solvent mixture.

d) a cyan dye layer of the anthraquinone cyan dye Sudan Blue GA illustrated below (0.84 g/m$^2$), the cyanine infrared absorbing dye illustrated below 0.13 g/m$^2$), and the amine identified in the table in a cellulose acetate propionate binder (2.5% acetyl, 46% propionyl) (0.42 g/m$^2$) coated from a dichloromethane and 1,1,2-trichloroethane solvent mixture.

Control dye-donor elements were prepared as described above, but no amine was added.

Each of the above dye-donor elements was overcoated with a spacer layer of crosslinked poly(styrene-co-divinyl benzene) beads (90:10 ratio) (12 μ average particle diameter) (0.065 g/m$^2$) and 10 G surfactant (a reaction product of nonylphenol and glycidol) (Olin Corp.) (0.011 g/m$^2$) in a binder of Woodlok ® 40-0212 white glue (a water based emulsion polymer of vinyl acetate) (National Starch Co.) (0.054 g/m$^2$.

Cyan Dye Sudan Blue GA

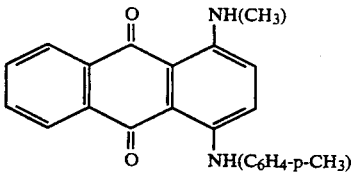

IR Absorbing Cyanine Dye

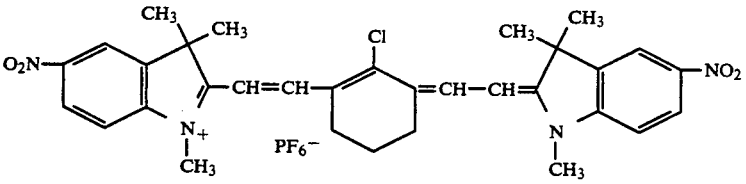

Dye-receiving elements were prepared by coating a layer of a poly(vinyl alcohol-co-butyral), Butvar B-76 ®, (Monsanto Corp.) (3.6 g/m$^2$) from a butanone and cyclohexanone solvent mixture on a 175 μm unsubbed poly(ethylene terephthalate support).

Neutral dye images were produced as described below by successively printing a set of yellow, magenta, and cyan dye-donor sheets onto the same area of the dye receiver using a laser imaging device similar to the one described in U.S. Ser. No. 457,595 of Sarraf et al, filed Dec. 27, 1989, entitled "Thermal Slide Laser Printer". The laser imaging device consisted of a single diode laser (Hitachi Model HL8351E) fitted with collimating and beam shaping optical lenses. The laser beam was directed onto a galvanometer mirror. The rotation of the galvanometer mirror controlled the sweep of the laser beam along the x-axis of the image. The reflected beam of the laser was directed onto a lens which focused the beam onto a flat platen equipped with vacuum grooves. The platen was attached to a moveable stage whose position was controlled by a lead screw which determined the y axis position of the image. The dye-receiver was held tightly to the platen by means of the vacuum grooves, and each dye-donor element was held tightly to the dye-receiver by a second vacuum groove.

The laser beam had a wavelength of 830 nm and a power output of 37 mWatts at the platen. The measured spot size of the laser beam was an oval of nominally 12 by 13 microns (with the long dimension in the direction of the laser beam sweep). The center-to-center line distance was 10 microns and the scan rate was 525 mm/sec.

The test image consisted of a series of 7 mm wide steps of varying dye density produced by modulating the current to the laser from full power to 45.3% power in 13.6% increments.

The imaging electronics were activated and the modulated laser beam scanned the dye-donor to transfer dye to the dye-receiver. The neutral step density image was formed by successively printing four step-images onto the same area of dye-receiver in the order of cyan, magenta, yellow, and cyan dye-donor each containing the same amine. After imaging, the dye-receiver was removed from the platen and the image dyes were fused into the receiving polymer layer by exposure to acetone vapors for 7 min.

The Status A Red transmission density of each step-image at 100% power (maximum density) and 73% power was read as follows:

| Amine in Donor* (g/m$^2$) | Status A Red Density | |
|---|---|---|
| | At 73% Power | At 100% Power |
| None (0,0,0) (Control) | 0.7 | 1.6 |
| A1 (0.12, 0.14, 0.16) | 1.3 | 2.8 |
| A2 (0.17, 0.19, 0.23) | 0.8 | 2.0 |
| A3 (0.29, 0.32, 0.38) | 0.8 | 2.4 |
| A4 (0.16, 0.17, 0.20) | 0.9 | 2.1 |

-continued

| Amine in Donor* (g/m²) | Status A Red Density At 73% Power | At 100% Power |
|---|---|---|
| A5 (0.10, 0.11, 0.13) | 0.9 | 2.1 |
| A6 (0.09, 0.10, 0.12) | 1.0 | 2.6 |
| A7 (0.04, 0.04, 0.05) | 0.9 | 2.1 |
| **None (0,0,0)(control) | 0.9 | 2.1 |
| **A1 (0.12, 0.14, 0.16) | 1.1 | 2.1 |

*Each amine with the exception of A6 was coated at 6 equivalents relative to the cyanine dye, thus the amines varied on a weight basis. Amine A6 was coated at 12 equivalents relative to the cyanine dye. Coated levels of amine are given for yellow dye-donor (a), magenta dye-donor (b), and cyan dye-donor (c), respectively.
**Anthraquinone cyan dye-donor (d) used.

The data above show that the addition of a tertiary amine to each of the dye-donors used for laser thermal dye-transfer of a neutral image minimized decomposition of the cyan dye and provided improved transferred red dye density. This effect was most pronounced in the intermediate density range. The beneficial effect of tertiary amines was applicable to cyan dyes of both the indophenol and anthraquinone classes.

EXAMPLE 2

This example is similar to Example 1 but used a different receiver polymer and shows that the effect of adding a tertiary amine and obtaining improved cyan dye density is not receiver related.

Individual dye-donor elements with a spacer layer were prepared as described in Example 1. Control dye-donors were prepared with a spacer layer as described in Example 1, but no amine was added.

Dye-receiving elements were prepared by injection molding 1.5 mm thick sheets of Makrolon CD-2000® bisphenol-A polycarbonate (Bayer AG).

Imaging of a neutral step density test image onto the receiver was done as described in Example 1.

After imaging, the dye-receiver was removed from the platen and the image dyes were fused into the polymer by heating with a 1980° K. lamp for 60 sec.

The Status Red transmission density of each step-image at 100% power (maximum density) and 73% power was read as follows:

| Amine in Donor* (g/m²) | Status A Red Density At 73% Power | At 100% Power |
|---|---|---|
| None (0,0,0) (Control) | 1.0 | 2.2 |
| A1 (0.12, 0.14, 0.16) | 1.2 | 2.6 |
| A2 (0.17, 0.19, 0.23) | 1.0 | 2.1 |
| A4 (0.16, 0.17, 0.20) | 1.1 | 2.4 |
| A5 (0.10, 0.11, 0.13) | 0.9 | 2.0 |
| A6 (0.09, 0.10, 0.12) | 1.0 | 2.4 |
| A7 (0.04, 0.04, 0.05) | 1.0 | 2.4 |
| **None (0,0,0) (control) | 1.1 | 2.3 |
| **A1 (0.12, 0.14, 0.16) | 1.2 | 2.5 |

*Each amine with the exception of A6 was coated at 6 equivalents relative to the cyanine dye, thus the amines varied on a weight basis. Amine A6 was coated at 12 equivalents relative to the cyanine dye. Coated levels of amine are given for yellow dye-donor (a), magenta dye-donor (b), and cyan dye-donor (c), respectively.
**Anthraquinone cyan dye-donor (d) used.

The data above again show that the addition of a tertiary amine to each of the dye-donors minimized decomposition of the cyan dye and provided improved transferred dye density. The results using this extruded polycarbonate receiver generally paralleled those of the poly(vinyl alcohol-co-butyral) receiver of Example 1. Again the beneficial effect of tertiary amines was applicable to cyan dyes of both the indophenol and anthraquinone classes.

The invention has been described in detail with particular reference to preferred embodiments thereof, but it will be understood that variations and modifications can be effected within the spirit and scope of the invention.

What is claimed is:

1. In a dye donor element for laser-induced thermal dye transfer comprising a support having thereon a dye layer comprising an image dye in a polymeric binder and an infrared absorbing dye associated therewith, the improvement wherein said layer also has a non-volatile tertiary amine associated therewith.

2. The element of claim 1 wherein said infrared absorbing dye is in said dye layer.

3. The element of claim 1 wherein said amine is in said dye layer.

4. The element of claim 1 wherein said amine is triethanolamine, N,N,N',N'-tetramethyl-1,8-naphthylenediamine, tri-n-octylamine, tris(2-hydroxypropyl)amine, N,N,N',N'-tetrakis(2-hydroxyethyl)ethylenediamine, diazabicyclo-2,2,2-octane, or pentamethyldiethylene triamine.

5. The element of claim 1 wherein said amine is triethanolamine.

6. The element of claim 1 wherein said amine is present at a concentration of 0.03 to 1.0 g/m².

7. In a process of forming a laser-induced thermal dye transfer image comprising:

a) contacting at least one dye-donor element comprising a support having thereon a dye layer in a polymeric binder having an infrared-absorbing dye associated therewith, with a dye-receiving element comprising a support having thereon a polymeric dye image-receiving layer;

b) imagewise-heating said dye-donor element by means of a laser; and c) transferring a dye image to said dye-receiving element to form said laser-induced thermal dye transfer image, the improvement wherein said dye layer also has a non-volatile tertiary amine associated therewith.

8. The process of claim 7 wherein said infrared absorbing dye is in said dye layer.

9. The process of claim 7 wherein said amine is in said dye layer.

10. The process of claim 7 wherein said amine is triethanolamine, N,N,N',N'-tetramethyl-1,8-naphthylenediamine, tri-n-octylamine, tris(2-hydroxypropyl)amine, N,N,N',N'-tetrakis(2-hydroxyethyl)ethylenediamine, diazabicyclo-2,2,2-octane, or pentamethyldiethylene triamine.

11. The process of claim 7 wherein said amine is triethanolamine.

12. The process of claim 7 wherein said amine is present at a concentration of 0.03 to 1.0 g/m².

13. In a thermal dye transfer assemblage comprising:

(a) a dye donor element comprising a support having thereon a dye layer comprising a dye dispersed in a polymeric binder having an infrared absorbing dye associated therewith, and (b) a dye-receiving element comprising a support having thereon a dye image-receiving layer, said dye-receiving element being in superposed relationship with said dye-donor element so that said dye layer is in contact with said dye image-receiving layer, the improvement wherein said dye layer also has a non-volatile tertiary amine associated therewith.

14. The assemblage of claim 13 wherein said infrared absorbing dye is in said dye layer.

15. The assemblage of claim 13 wherein said amine is in said dye layer.

16. The assemblage of claim 13 wherein said amine is triethanolamine, N,N,N', N'-tetramethyl-1,8-napgthylenediamine, tri-n-octylamine, tris(2-hydroxypropyl-)amine, N,N,N', N'-tetrakis(2-hydroxyethyl)ethylenediamine, diazabicylco-2,2,2-octane, or pentamethyldiethylene triamine.

17. The assemblage of claim 13 wherein said amine is triethanolamine.

18. The assemblage of claim 13 wherein said amine is present at a concentration of 0.03 to 1.0 g/m$^2$.

* * * * *